US006702274B1

(12) United States Patent
Otsuka

(10) Patent No.: US 6,702,274 B1
(45) Date of Patent: Mar. 9, 2004

(54) PRINTING APPARATUS AND PRINTING METHOD

(75) Inventor: Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 09/628,022

(22) Filed: Jul. 28, 2000

(30) Foreign Application Priority Data

Jul. 30, 1999 (JP) ..... 11-217218

(51) Int. Cl.[7] ..... B65H 5/00

(52) U.S. Cl. ..... 271/10.01; 271/258.01; 271/265.01

(58) Field of Search ..... 347/104; 271/10.01, 271/10.02, 10.03, 258.01, 265.01

(56) References Cited

U.S. PATENT DOCUMENTS 5,664,771 A * 9/1997 Nagatani et al. ..... 271/10.03
6,074,055 A * 6/2000 Myung ..... 347/104
6,076,821 A * 6/2000 Embry et al. ..... 271/10.01
6,234,694 B1 * 5/2001 Brookner ..... 347/104 X
6,290,351 B1 * 9/2001 Merz ..... 347/104

FOREIGN PATENT DOCUMENTS

JP 2775767 5/1998

* cited by examiner

*Primary Examiner*—David H. Bollinger
(74) *Attorney, Agent, or Firm*—Fitzpatrick, Cella, Harper & Scinto

(57) ABSTRACT

In a printing apparatus a printing medium is fed such that before a paper sensor detects a trailing edge of a preceding printing medium, a paper feeding roller begins the feeding of a succeeding printing medium, and after the paper sensor detects the trailing edge of the preceding printing medium, a leading edge of the succeeding printing medium arrives at the location of the paper sensor. Thus, the feeding of printing paper is performed rapidly and consequently the printing apparatus can perform recording rapidly.

18 Claims, 9 Drawing Sheets

PRINTING APPARATUS AND PRINTING METHOD

BACKGROUND OF THE INVENTION

1. Field of the Invention

The present invention relates to a printing apparatus and a printing method, and relates in particular to a printing apparatus for high-speed paper supply and a printing method therefor.

2. Related Background Art

In a conventional apparatus, in order to increase printing speeds and to simplify mechanisms, a paper feeding mechanism, a paper conveying mechanism and a carriage mechanism are independently driven, or special motors are provided to drive these mechanisms at optimal timings.

However, the following problem plagues a conventional system, comprising these mechanisms, that initiates the feeding of a succeding printing medium without detecting the trailing end of a preceding printing medium. For example, when the lengths of printing media differ between a predecessor and a successor or when the lengths of the printing media vary, or when slippage occurs at a paper feeding mechanism, preceding and succeding media overlap each other, so that in a printing apparatus that has only one paper sensor a trailing edge of the preceding printing medium and a leading edge of the succeeding one cannot be discriminated, thereby causing paper feeding failures.

If the trailing end of the preceding printing medium is detected first and then the feeding of the succeeding printing medium is started, the above problem can be avoided. However, unless the sensor for the printing medium is located very near the feeding mechanism, a satisfactory effect can not be obtained because the interval between the preceding and succeeding printing media will be extended. Further, in the printing apparatus, the leading edges of printing media are detected immediately after the media are fed by a feeding mechanism, so that, if because of slippage the feeding distance of the printing media varies before they reach the sub-scanning mechanism, there is no means available to correct such variation. Therefore, no conventional printing apparatuses can cope with reductions in the intervals between printing media that are consecutively fed, stabilization in positioning the leading edges, and differences in the lengths of printing media. For removing the above-mentioned trouble, it is generally effective to employ two paper sensors, but such a use results in increased manufacturing costs.

SUMMARY OF THE INVENTION

It is, therefore, one objective of the present invention to provide a printing apparatus that enables fast printing, by increasing the speed of the paper feeding operation, and a printing method therefor.

To achieve the above objective, according to one aspect of the invention, a printing apparatus for printing on a printing medium employing a printing head, comprises:

feeding means for feeding a printing medium toward the printing head;

detection means for detecting an edge of the printing medium fed by the feeding means; and control means for controlling the driving of the feeding means so as to (1) cause the feeding means to initiate the feeding of a succeeding printing medium after the feeding means initiates the feeding of a preceding printing medium and before the detection means detects a trailing edge of the preceding printing medium and (2) cause a leading edge of the succeeding printing medium to arrive at the detection means after the detection means detects the trailing edge of the preceding printing medium.

Further, according to another aspect of the invention, a printing method for printing on a printing medium with a printing head, comprises the steps of:

feeding a printing medium toward the printing head;

initiating the feeding of a succeeding printing medium toward the printing head, after the feeding of a preceding printing medium is initiated and before a trailing edge of the preceding printing medium is detected at a predetermined position; and feeding the succeeding printing medium so that a leading edge of the preceding printing medium arrives at the predetermined position after the leading edge of the preceding printing medium is detected at the predetermined position.

In this specification, "printing" includes not only the formation of meaningful information, such as characters or figures, on a printing medium, but also includes the formation of various images, designs and patterns on a printing medium or the processing employed for the printing medium, whether or not they convey any meanings or whether or not they can be visually distinguished by humans.

The term "printing medium" refers not only to a paper that is used by a common printing apparatus, but also to various other types of media, such as cloth, plastic film and metal plates, that can accept ink.

Further, "ink" should be appreciated broadly as the definition of "printing". That is, it should be understood as liquid that can be applied onto a printing medium to form images, designs and patterns, or liquid that can be used to process the printing medium.

DETAILED DESCRIPTION OF THE PREFERRED EMBODIMENT

Figure 1:
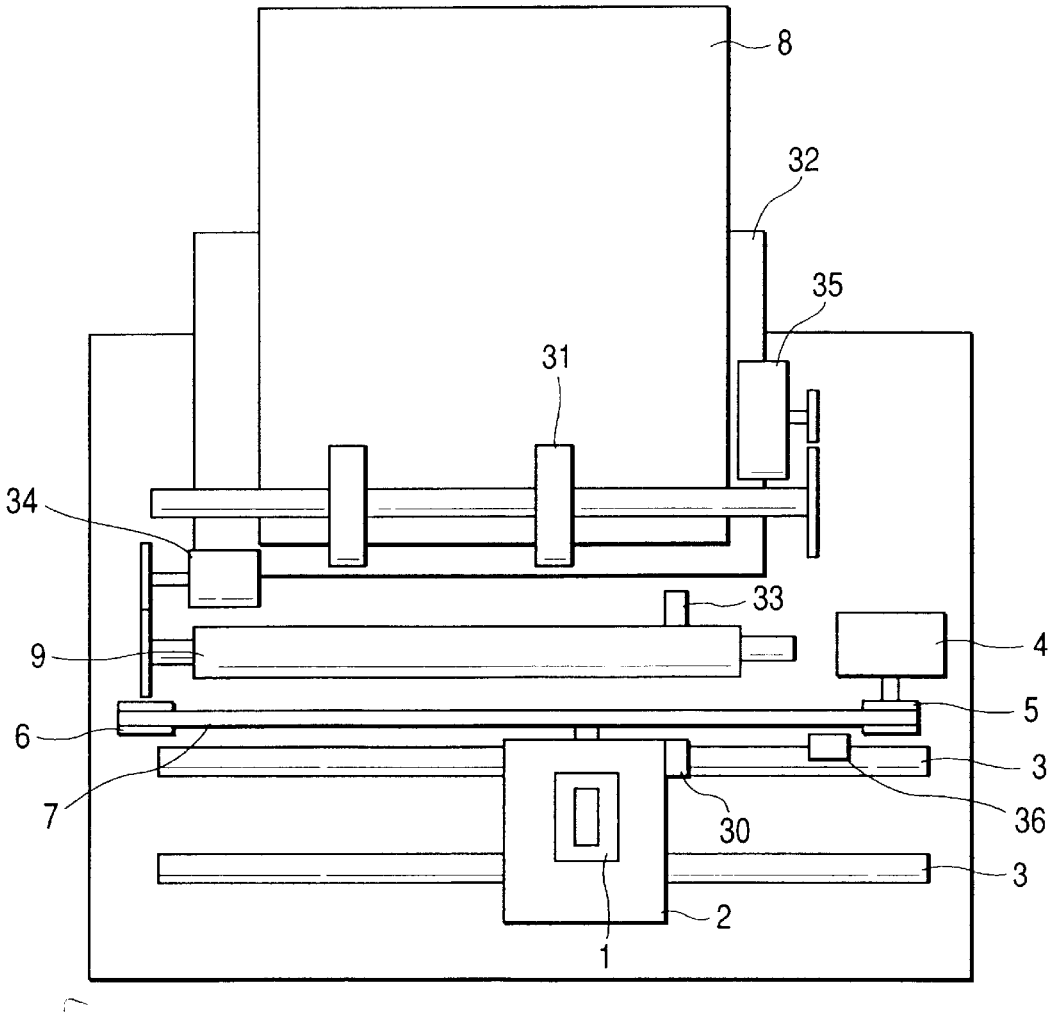
FIG. 1 is a schematic diagram illustrating the arrangement of an ink-jet printing apparatus according to one embodiment of the present invention.

According to one embodiment of the invention, a printing apparatus, which includes a fast printing mechanism, determines whether or not paper feeding should be continued when a leading edge of a succeeding printing medium is immediately before a paper sensor while a trailing edge of a preceding printing medium passes through the paper sensor. Therefore, such a system can be provided that enables the precise feeding of preceding and succeeding printing media, even when the media overlap.

If it is determined that the continuous paper feeding is permitted, the process is not interrupted, so that compared with a conventional apparatus, which must start feeding after the determination by the sensor, the printing apparatus of this invention can feed paper very rapidly. In addition, even when the apparatus temporarily halts the feeding, it resumes the feeding immediately after detecting the actual trailing edge of the preceding printing media. Thus, unlike the conventional art, overlapped paper feeding does not occur. Further, the paper feeding may start when preceding and succeeding printing media overlap. In this case, since a required distance between the printing media is maintained immediately before the sensor, an amount for movement to a cue position is precisely controlled and the minimum possible real distance is maintained. Furthermore, the paper feeding may start when the media are separated. In short, the interval between the printing media and the timing for the paper feeding mechanism can be arbitrarily set. Since during printing a serial type printing apparatus intermittently feeds a preceding printing medium in the sub-scanning direction, the paper feeding interval is not constant unlike the paper feeding mechanism which conducts consecutive paper feeding. However, as described above, according to the method of the invention an arbitrary interval is set until the paper reaches the paper sensor, so that for the design, the degree of freedom increases.

The reduction in the paper feeding and the paper discharge time can most efficiently increase the throughput in the printing apparatus. For example, for a printing apparatus having a printing speed of 10 ppm, the average time for printing a sheet is six seconds. But when the paper feeding time is three seconds per sheet, the printing itself requires only three seconds.

The paper feeding and discharging is sorted into the three following cases.

1) When the paper feeding is performed to print the first printing medium.
2) When the printing of a preceding printing medium is completed and the feeding of a succeeding printing medium is begun while the preceding printing medium is being discharged.
3) When the feeding of a succeeding printing medium is begun while a preceding printing medium is being printed.

The full paper feeding time is required for the item 1), that is, for the paper feeding to print on the first printing medium. In this case, the operation having the highest priority is the paper feeding at maximum speed from an ASF.

In the item 2), the printing of a preceding printing medium is completed and the feeding of a succeeding printing medium is begun while discharging the preceding medium. In this case, the current position of the preceding printing medium is calculated with executing the driving in the sub-scanning direction to discharge the preceding printing medium, and the driving for feeding a succeding printing medium is begun at an optimal position. In this case, the operations having the highest priority are the prompt completion of the paper discharge, and termination of the paper feeding when the discharge process has been completed.

For that attainment, the distance between the preceding and succeeding printing media is minimized, and a printing medium is made controllable at a position, immediately preceding the paper sensor, so as to cause the paper sensor to accurately detect a trailing edge of the preceding printing medium and a leading edge of the succeeding printing medium. Thus, printing can be started at a precise location relative to the position, in the sub-scanning direction, of the leading edge of the succeeding printing medium. Especially, in order to obtain a precise cue positioning distance, it is preferable for the paper sensor to be located as far as possible from the paper feeding mechanism and relatively near a delivery roller for sub-scanning. This arrangement is very effective because the paper feeding process can be initiated regardless of a signal from the paper sensor.

In the item 3), the feeding of a succeeding printing medium is begun while a preceding printing medium is being printed. In this case, the current position of the preceding printing medium is calculated, and the driving for feeding the succeeding printing medium is begun at the optimal location. In this case, since the printing of the preceding printing medium is driven continuously, the carriage mechanism must be driven in addition to the printing by the printing head.

In these cases, three drivings are executed at the same time, that is, in addition to the paper feeding, the above-mentioned two drivings are executed intermittently.

Therefore, as a method for feeding a succeeding printing medium, the medium can be intermittently driven in the sub-scanning direction, the preceding and succeeding printing media can be driven substantially at the same average speed, or the preceding and succeeding printing media can be delivered to a position immediately preceding the paper sensor at the same time, while it is permitted that a leading edge of the succeeding printing and a trailing edge of the preceding printing medium overlap.

With either method, the paper feeding is not started by determination by means of the paper sensor, but started based on information on the length of the preceding printing medium or a fixed value. Thus, the feeding of the succeeding printing medium may be begun from the time when the preceding and succeding printing media overlap or they are separated with an interval therebetween. Furthermore, since a distance between the printing media can be used up to the paper sensor located immediately before the convey roller, the degree of freedom for control is great, even when the printer is a serial printer that feeds the preceding printing media intermittently and basically consecutively feeds the succeeding printing medium.

Preferred embodiments of the present invention will now be described in detail while referring to the accompanying drawings. In the drawings, the same reference numerals are used to denote respective corresponding or identical components.

(Arrangement 1 of printing apparatus)

FIG. 1 is a diagram showing the arrangement of an essential portion of an ink-jet printing apparatus according to an embodiment of the present invention.

In FIG. 1, a head cartridge (or head cartridges) 1 is positionally and exchangeably mounted on a carriage 2. The head cartridge 1 includes a printing head and an ink tank, and further comprises a connector (not shown) for receiving/sending various signals such as a printing head driving signal.

A connector holder (electrical connector) is provided in the carriage 2 to transmit the drive signal and others to the head cartridge 1 therethrough.

The carriage 2 is supported by a guide shaft 3, which is provided in a main body of the apparatus and which is extended in the main scanning direction, along which the carriage 2 reciprocates. The carriage 2 is driven by a main scan motor 4 via a drive mechanism that is constituted by a motor pulley 5, a coupled pulley 6, a timing belt 7, etc. and its position and movement are controlled. Further, a home position sensor 30 is provided on the carriage 2. The location of the carriage 2 is detected when it passes a shielding plate 36.

As a pickup roller 31 is rotated, via drive gears, by a feed motor 35, printing media 8, such as a printing sheet or a thin plastic plate, are separately fed, one by one, from an auto sheet feeder (hereinafter referred to as an ASF) 32. Further, as a conveyer roller 9 is rotated, the printing medium 8 is conveyed (or sub-scanned) passing through a position (a printing unit) opposite to a discharge port face of the head cartridge 1. The conveyer roller 9 is driven, via the drive gears, by the rotation of an LF (line feed) motor 34. At this time, the discrimination as to whether a printing medium has been fed, and the determination of the cue position of the printing medium 8 are done at the time the feeding is done when the printing medium 8 passes through a paper end sensor 33. The paper end sensor 33 is also employed to acquire an actual location of a trailing edge of the printing medium 8 and to calculate the current printing location based on the actual trailing edge position. It is noted that a back side of the printing medium 8 is supported by a platen (not shown) in order to provide a flat printing surface at the printing unit. In this case, each head cartridge 1 mounted on the carriage 2 is supported so that the faces of the discharging portions protrude downward from the carriage 2, and are parallel to the printing medium 8 between the two sets of rollers. The head cartridge 1 is an ink-jet head cartridge that employs thermal energy to eject ink and includes electro-thermal converting elements for generating the thermal energy. That is, bubbles are generated by film boiling induced by the thermal energy that is applied by the electro-thermal converting elements, and the printing head of the head cartridge 1 employs the pressure exerted by the air bubbles to eject ink through the discharging orifices for printing.

Figure 2:
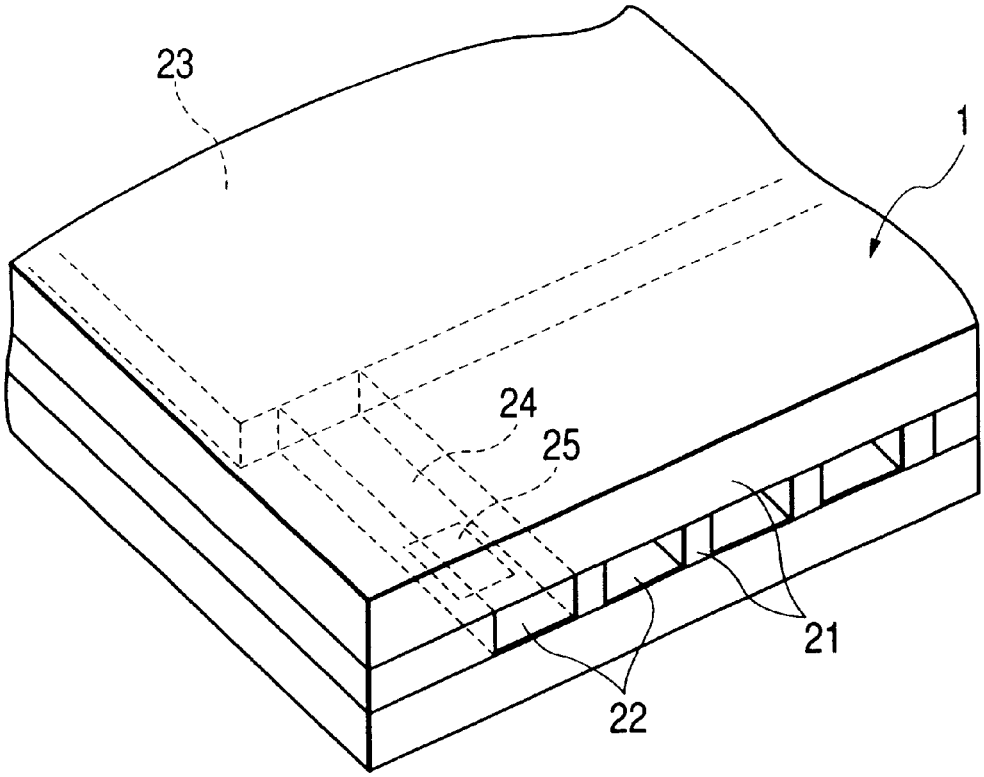
FIG. 2 is a specific perspective view of the structure of an essential portion of a printing head.

FIG. 2 is a specific, partial perspective view of the structure of an essential portion of the printing head of a head cartridge 1.

In FIG. 2, a plurality of discharging orifices 22 are formed at a predetermined pitch on a surface of a discharging portion 21 that is positioned opposite, at a predetermined distance (e.g., about 0.5 to 2.0 mm), from the printing medium 8. Electro-thermal converting elements (heat-generating elements) 25, located along a wall of each of the liquid paths 24 that connect a common liquid chamber 23 and the discharging orifices 22, generate energy to be used for ink ejection. In this embodiment, a print head 13 is so configured that the head cartridge 1 is mounted on the carriage 2, the discharging orifices 22 are arranged in a direction perpendicular to the scanning direction of the carriage 2, the corresponding electro-thermal converting elements (hereinafter also referred to as ejection heaters) 25 are driven (or energized) based on an image signal or an ejection signal, to cause film boiling of ink in the liquid paths 24, and the pressure thus generated is used to eject ink through discharging orifices 22.

Figure 3:
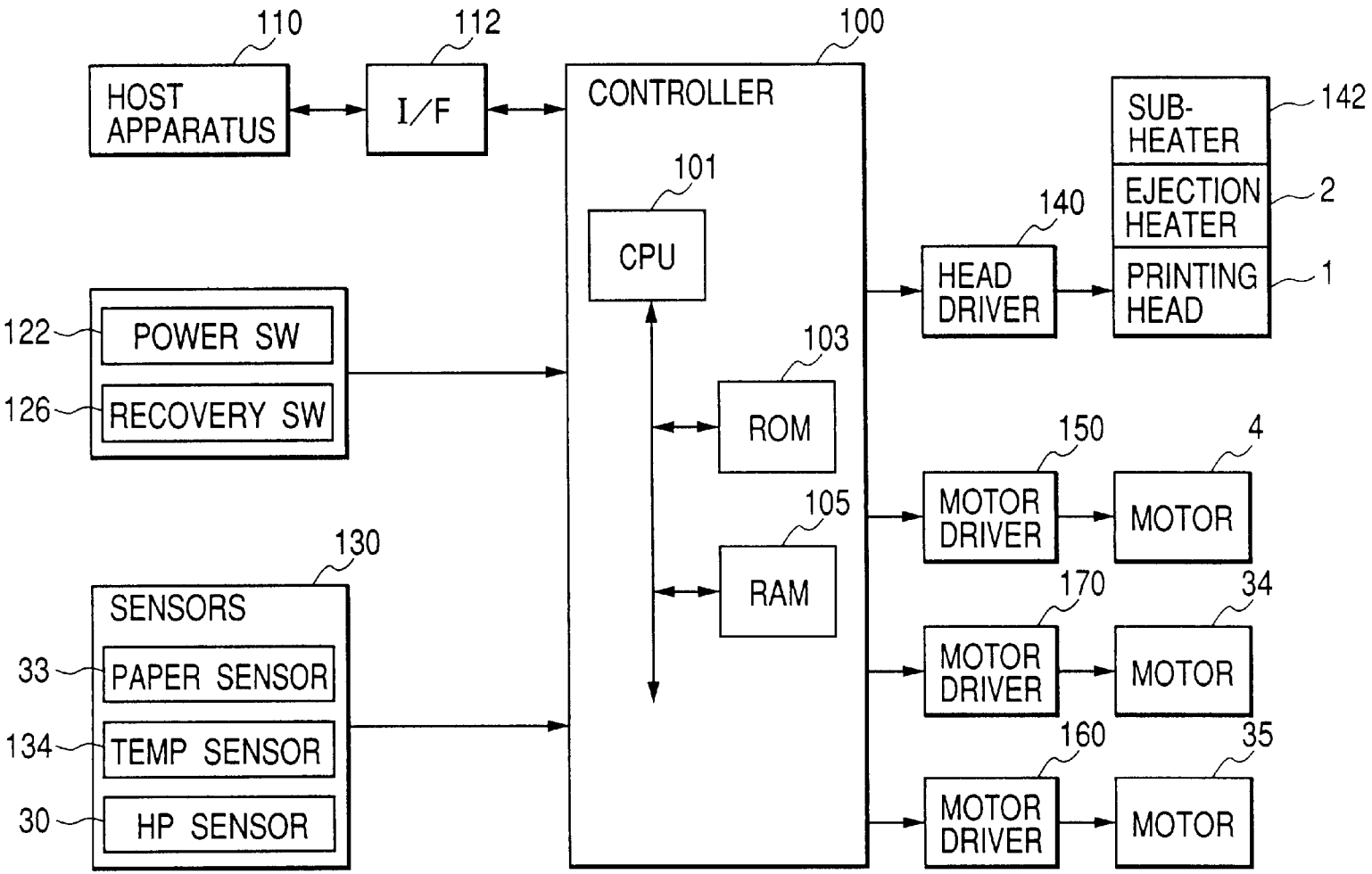
FIG. 3 is a schematic block diagram illustrating the arrangement of a controller circuit in the ink-jet printing apparatus according to the embodiment of the present invention.

FIG. 3 is a schematic block diagram illustrating an example arrangement of a control circuit for the ink-jet printing apparatus.

In FIG. 3, a controller 100 is a main control unit, and includes a CPU 101, for example, a micro computer, a ROM 103, used to store programs, required tables and other fixed data, and a RAM 105, which has an area for developing image data and a work area. A host apparatus 110 is an image data supplying source (for example, a computer for creating and processing image data for printing, or an image reader). The image data and other commands and status signals are exchanged with the controller 100 via an interface (I/F) 112.

A console unit 120 constituted by switches, including a power switch 122 and a recovery switch 126 for instructing the initiation of a suction recovery, accepts instructions entered by an operator.

Sensors 130 are used to detect the state of the apparatus, and include the home position sensor 30 described above, a paper end sensor 33 for detecting the presence of a printing medium, and a temperature sensor 134 provided at an appropriate location to detect an environmental temperature.

A head driver 140 drives the ejection heaters 25 of the printing head 1 in accordance with print data. The head driver 140 includes a shift register for aligning print data to correspond to the position of the ejection heaters 25, a latch circuit for latching print data at appropriate timings, a logical circuit element for driving the ejection heater 25 in synchronization with a drive timing signal, a timing setting unit for appropriately setting the drive timing to arrange the dot formation position, and so on.

A sub-heater 142, provided in the printing head 1, adjusts the temperature to stabilize the ink discharge characteristic. The sub-heater 142 is formed on a printing head substrate together with an ejection heater 25, or is attached to the main body of the printing head 1 or to the head cartridge.

A motor driver 150 drives the main scan motor 4, the sub-scan motor 34 is used to convey (sub-scan) the printing medium 8, and a motor driver 170 drives the sub-scan motor 34. A feeding motor 35 is used to separately convey the printing medium 8 from the ASF, and a motor driver 160 drives the feeding motor 35.

The paper feeding processing performed in each state will now be described.

In order to clarify the differences between the present invention and the conventional art, a conventional fast, consecutive paper feeding method is shown in FIGS. 4A to 4E.

Figures 4A, 4B, 4C, 4D, 4E:
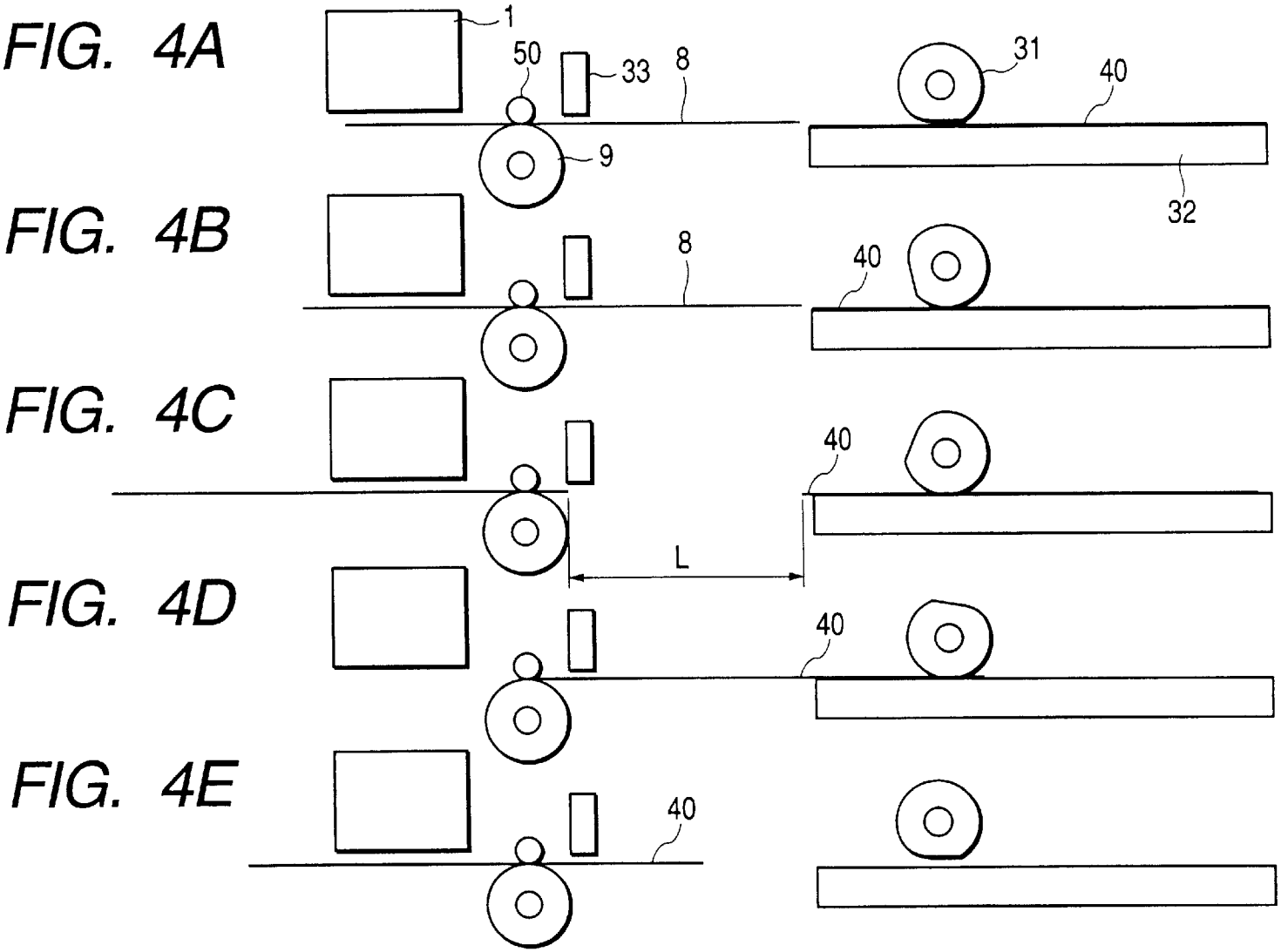
FIGS. 4A, 4B, 4C, 4D and 4E are diagrams showing a conventional consecutive feeding method.

The paper feeding sequence advances in order from FIGS. 4A to 4E. In FIG. 4A, a preceding printing medium 8 is sandwiched between the conveyer roller 9 and a pinch roller 50 and conveyed by their conveyance in the sub-scanning direction. In this state, the output of the paper sensor 33 still indicates that paper is present. In the conventional art, even if, by reading data in advance, it is ascertained that data to be printed on a succeeding printing medium 40 is present, the paper feeding should be resumed with the development of the data in advance, but the paper feeding mechanism cannot be driven for the succeeding printing medium 40 unless a trailing edge of a preceding printing medium 8 is detected. Therefore, a constant interval is always required before the preceding printing medium 8 passes through the paper sensor 33. As a result, in FIG. 4C, the feeding of the succeeding printing medium 40 is initiated and at this time, a distance represented by L appears between the printing media. Then, in FIG. 4D, the succeeding printing medium 40 passes through the paper sensor 33, which detects the presence of paper. Based on this timing the cue position of the succeeding printing medium 40 is calculated. And in FIG. 4E, the succeeding printing medium 40 reaches the cue position, the conveyer roller 9 is halted, and the print cartridge 1 is driven in the main scanning direction.

According to the conventional method, the development of data for the succeeding printing medium 40 is conducted precedingly and parallel processing is executed, so that overlapping is permitted in the data handling processing and fast consecutive feeding is enabled accordingly. In addition, since the feeding of the succeeding printing medium is initiated after an output of the paper sensor 33 is examined, precise paper feeding can be provided without overlapped paper feeding or the occurrence of paper jam. However, relative to the feeding time, the distance L is always required. When the paper sensor 33 is located closer to the feed roller 31, this distance L is reduced. However, since the feed roller 31 slips on the surface of a printing medium during the feeding process and an error in conveyed distance occurs, the error tends to become large when a printing medium must travel a long distance before it reaches the conveyer roller 9 after passing through the paper sensor 33.

As an improved conventional method, information concerning the length of a preceding printing medium 8 is read in advance, and the feeding of a succeeding printing medium 40 is initiated without considering a trailing edge of the preceding printing medium 8. According to this method, the succeeding printing medium 40 can be fed at a comparatively short interval L, while the paper sensor 33 is positioned near the conveyer roller 9.

For this method, the information for the length of the preceding printing medium 8 must be obtained in advance. This information can be acquired comparatively easily if a dedicated paper cassette is employed for each printing medium size, and it is an effective size detection means. However, with this method, if the ASF compatible with a universal size printing medium is used instead of a dedicated paper cassette, the size of a printing medium cannot be determined within a paper feeding device. In this case, information concerning the size of a printing medium must be externally provided, by a user's set data on a printer driver in a host computer. When, for example, a user loads A4 size paper when the setting is for LETTER size, if the distance between the preceding printing medium 8 and the succeeding printing medium 40 is too short, these media 8 and 40 will be fed with the trailing edge of the medium 8 and the leading edge of the medium 40 overlapped, because the A4 size paper is longer. As a result, the paper sensor 33 cannot detect the trailing edge of the preceding printing medium 8 or the leading edge of the succeeding printing medium 40, and a printing error will occur.

An embodiment of the present invention is shown in FIGS. 5A to 5E.

Figures 5A, 5B, 5C, 5D, 5E:
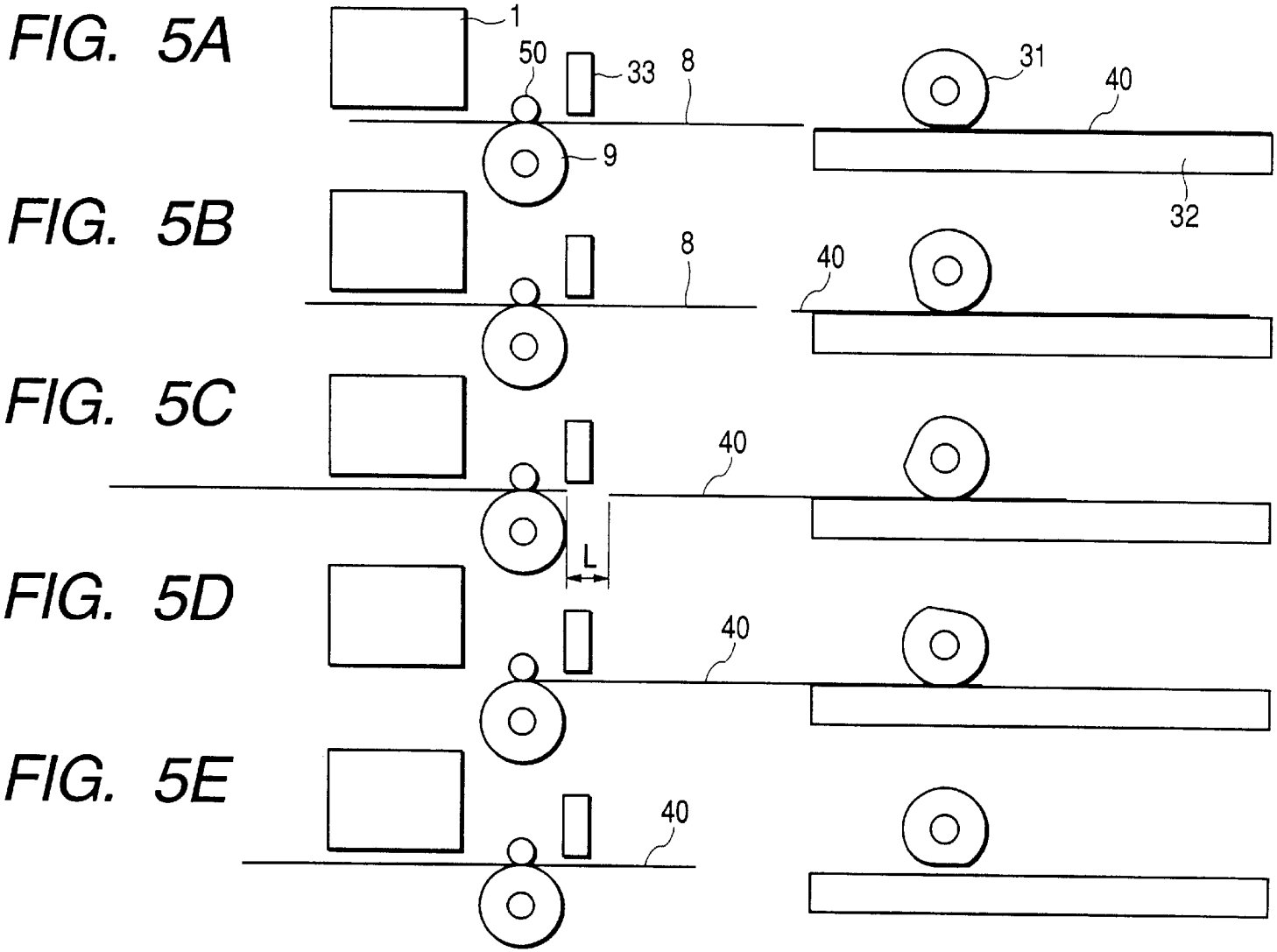
FIGS. 5A, 5B, 5C, 5D and 5E are diagrams showing a consecutive feeding method according to the present invention.

In FIGS. 5A to 5E, consecutive paper feeding can be performed with only a minimum gap defined between a preceding printing medium 8 and a succeeding printing medium 40. In FIG. 5A, the preceding printing medium 8 has been fed and is being printed. Then, in FIG. 5B, the accumulated value of the distance by which the printing medium 8 has been fed after the printing medium 8 passed the paper sensor (edge detection means) 33 is used to calculate the location of a trailing edge of the preceding printing medium 8 based on the length of the printing medium 8 obtained in advance. Then, in accordance with that calculation, it is ascertained that the printing medium 8 and the printing medium 40 are separated. Then, the paper feeding roller 31 is rotated, and the feeding of the succeeding printing medium 40 from the ASF is begun. In FIG. 5C, the absence of paper is detected after the preceding printing medium 8 has passed the paper sensor 33, and the succeeding printing medium 40 has been fed to a position immediately before the paper sensor 33. At this time, the location of the leading edge of the succeeding printing medium 40 already obtained from a value calculated based on the rotation of the paper feeding roller 31 is used, a check is performed to determine whether the trailing edge of the preceding medium 8 has passed the paper sensor 33 and the absence of paper is detected accordingly. In this state, since the information on the length of the preceding printing medium is substantially the same as the actual length, the distance L between the preceding printing medium 8 and the regularly succeeding printing medium 40 is the same as was estimated.

In this state, the succeeding printing medium 40 can be successively fed to the conveyor roller 9, without the stoppage of the paper feeding. As a result, the printing media, separated with a minimum paper feeding interval, can be consecutively fed at high speed without paper overlapping occurring, while at the same time, precise control of the cue position of the succeeding printing medium 40 is ensured. Subsequently, in FIG. 5D, the preceding printing medium 8, which is not shown, has been discharged, and the succeeding printing medium 40 has been delivered to and positioned at the conveyor roller 9. In FIG. 5E, the paper feeding process has been completed and the printing is being performed.

Figures 6A, 6B, 6C, 6D, 6E:
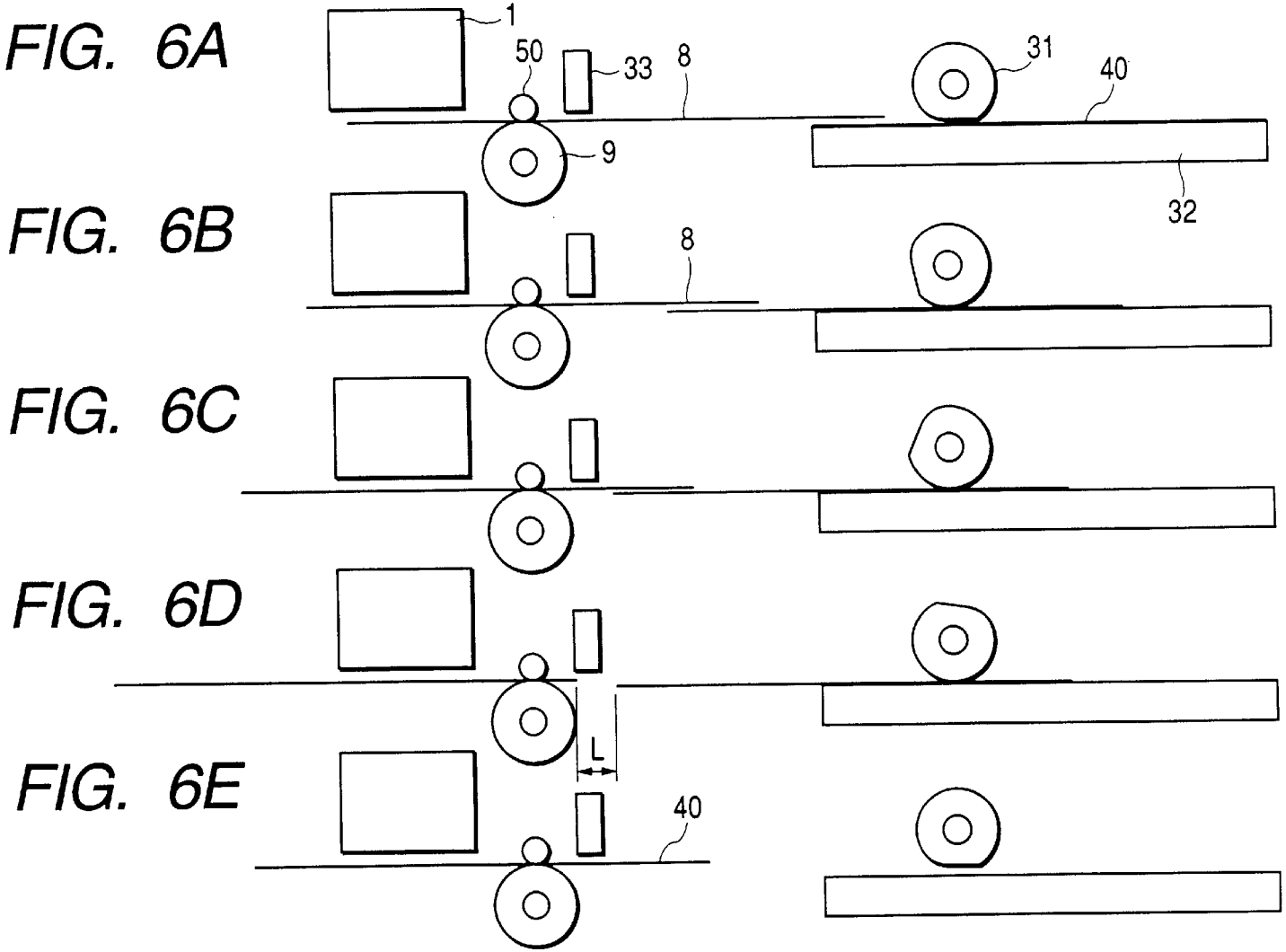
FIGS. 6A, 6B, 6C, 6D and 6E are diagrams showing the consecutive feeding method according to the present invention.

FIGS. 6A to 6E depict the processings in the above-mentioned embodiment, which is performed when the actual length of a preceding printing medium 8 differs from the length obtained in advance. In this embodiment, the actual length of the preceding printing medium 8 is longer than the length obtained in advance. In FIG. 6A, the preceding printing medium 8 has been fed and is being printed. Then, in FIG. 6B, the accumulated value of the distance by which the printing medium 8 has been fed after the printing medium 8 passed the paper sensor (edge detection means) 33 is used to calculate the location of a trailing edge of the preceding printing medium 8 based on the length of the printing medium 8 obtained in advance. Then, in accordance with that calculation, it is ascertained that the printing medium 8 and the printing medium 40 are separated. Then, the paper feeding roller 31 is rotated, and the feeding of the succeeding printing medium 40 from the ASF is begun. However, since the actual length of the preceding printing medium 8 is longer than the length obtained in advance the preceding printing medium 8 and the succeeding printing medium 40 are fed in an overlapped state. In FIG. 6C, it is calculated by the rotation of the paper feeding roller 31 that the succeeding printing medium 40 has been fed to a location immediately preceding the paper sensor 33, and at that time, a check is performed to determine whether the absence of paper is presently detected by detecting whether the preceding printing medium 8 has passed the paper sensor 33. In this case, since the actual length of the preceding printing medium 8 is longer than the length obtained in advance in the printing apparatus, the rotation of the paper feeding roller 31 is halted, or the rotation speed is reduced, so that the succeeding printing medium 40 does not arrive at the paper sensor 33. In FIG. 6D, the preceding printing medium 8 has passed the paper sensor 33 and then the absence of paper is presently detected. At this time, the rotation of the paper feeding roller 31 is resumed at such timing that the interval between the preceding and succeeding printing media 8 and 40 may be equal to the distance L. And finally, in FIG. 6E, the paper feeding process has been completed and the printing of the succeeding printing medium is performed.

As described above, according to the present invention, even if the actual length of a printing medium 8 differs from the length set in advance, the paper feeding process is performed correctly, and the cue position of the succeeding printing medium 40 may be controlled precisely. Further, the minimum interval L, as required, can be maintained.

Figure 7:
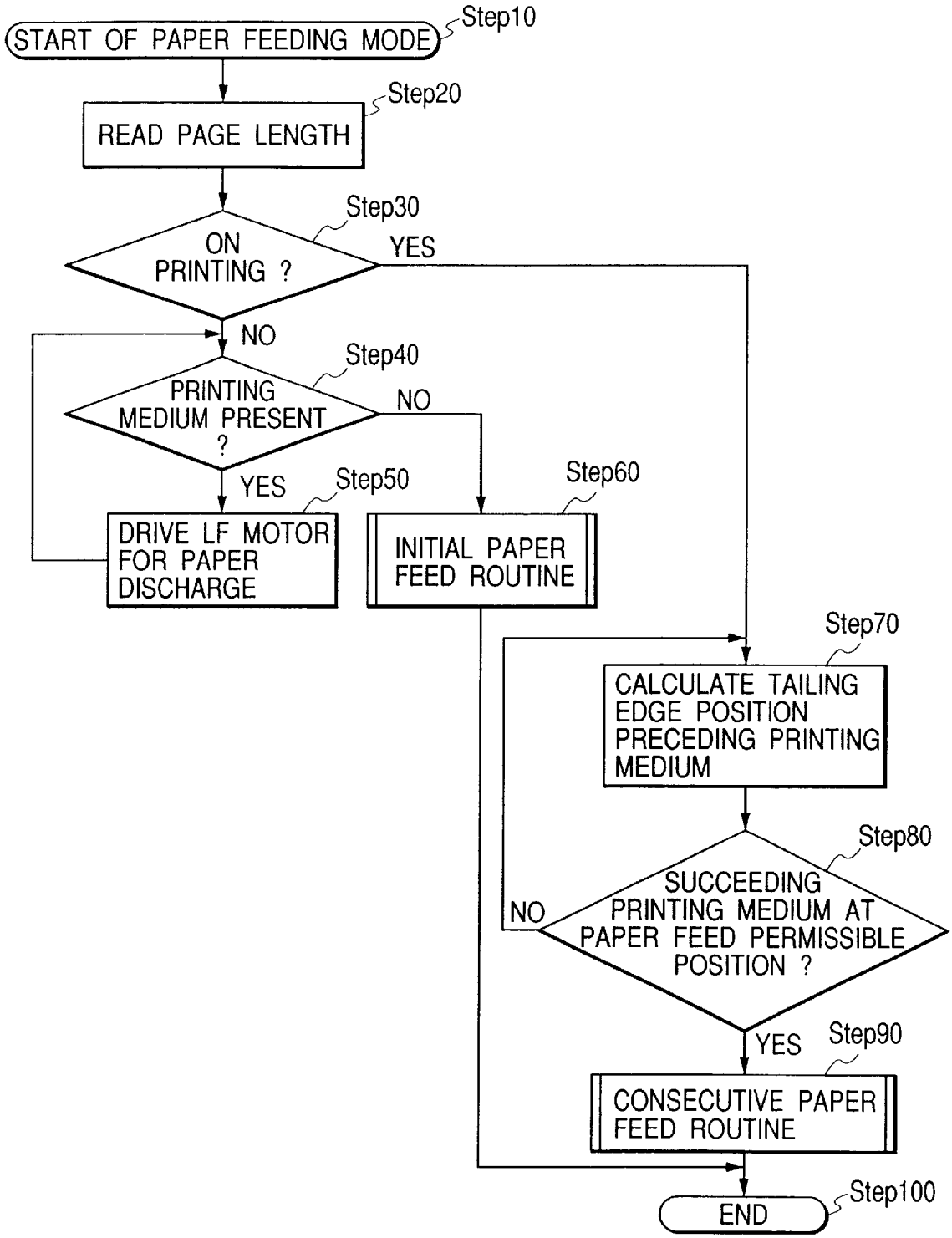
FIG. 7 is a flowchart for the control performed for the invention.

The above processing performed by the CPU 101 will now be described referring to the flowchart shown in FIG. 7. At Step 10, upon the receipt of a paper feeding instruction, a paper feeding mode is initiated. At Step 20, information concerning the length of a printing medium to be supplied is obtained. In this embodiment, the information is obtained from page length (information concerning the length of printing medium) in the settings on a printing medium of the print information received from a printer driver at a host computer end. The above information may be obtained from other information used to specify the length, such as information concerning the size, shape or type of a paper cassette and the width of a printing medium. A flow thereafter advances to Step 30. At Step 30, a check is performed to determine whether a preceding printing medium 8 is currently being printed. If the preceding printing medium 8 is not currently being printed, at Step 40 the paper sensor is employed to determine whether the preceding printing medium 8 is still present in the printing area. If the preceding printing medium 8 is still present in that area, at Step 50, the LF mode is activated to execute a paper discharge process, and the preceding printing medium 8 is discharged. However, when the discharge process has been completed, at Step 60 an initial paper feeding routine is begun. The initial paper feeding routine is for feeding a first sheet, and when the paper feeding routine has been completed, the flow advances to Step 100, whereat the paper feeding mode is terminated and the actual printing is begun.

However, if at Step 30 the preceding printing medium 8 is currently being printed, the flow shifts to Step 70, and a position of a trailing edge of the preceding printing medium 8 is calculated. Then at Step 80, according to where the position of the trailing edge of the preceding printing medium 8 is, it is determined whether a succeeding printing medium 40 can be separated and fed from the ASF 32. If the preceding printing medium 8 has reached a location where the paper feeding process can be initiated, at Step 90 a consecutive paper feeding routine is activated. Then, when the paper feeding process has been completed, the flow advances to Step 100 and the paper feeding mode is terminated.

Figure 8:
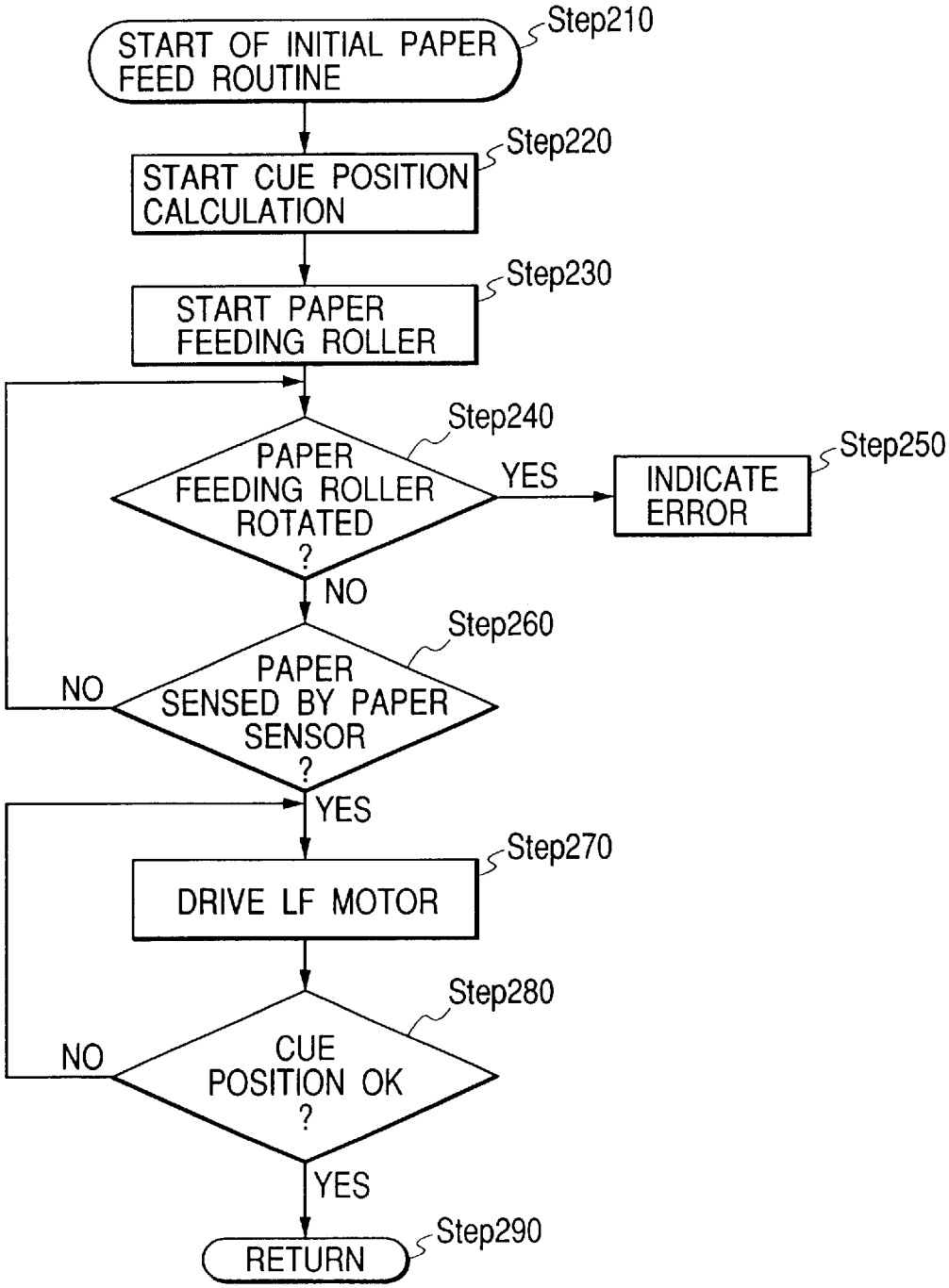
FIG. 8 is a flowchart for the control performed for the invention.

The initial paper feeding routine will be now described. This routine is initiated at Step 210 in FIG. 8. At Step 220, the calculation of the cue position of a printing medium to be fed is performed, and at Step 230 the rotation of the paper feeding roller 31 at the ASF 32 is begun. Generally, for a serial printer, after printing has begun, printing media are intermittently delivered in the sub-scanning direction. In order to prevent the precision of the delivery from being deteriorated due to the application of pressure to the fed printing media by the paper feeding roller, a semi-circular roller is frequently employed. Therefore, the paper feeding roller 31 is rotated once to complete the paper feeding process, and is then halted. At Step 230, an instruction is issued to start the rotation of the paper feeding roller 3, and at Step 240, a check is performed to determine whether the paper feeding roller 3 has been rotated once. Since at the time the paper feeding process is initiated, the paper feeding roller 31 is not, of course, being rotated, the flow advances to Step 260, whereat the preceding printing medium 8 arrives at the paper sensor 33. If the paper feeding roller 31 has completed the rotation before the preceding printing medium 8 has reached the paper sensor 33, it is determined that a paper feeding failure has occurred because of slippage at the printing medium, or that no printing medium is loaded in the ASF 32. The flow then shifts to Step 250, whereat the occurrence of an error is indicated. At Step 260, at the time when the preceding printing medium 8 has reached the paper sensor 33, the rotation of the ASF 32 is continued until one full revolution has been completed. The flow then advances to Step 270, whereat the rotation of the conveyor roller 9 is performed to complete the feeding of the paper. At this time, the feeding distance of the printing medium 8 is calculated when the paper sensor 33 detects the presence of paper, then the rotation of the conveyor roller 9 is driven to feed the preceding printing medium 8 to the cue position. And the initial paper feeding routine is terminated.

Figure 9:
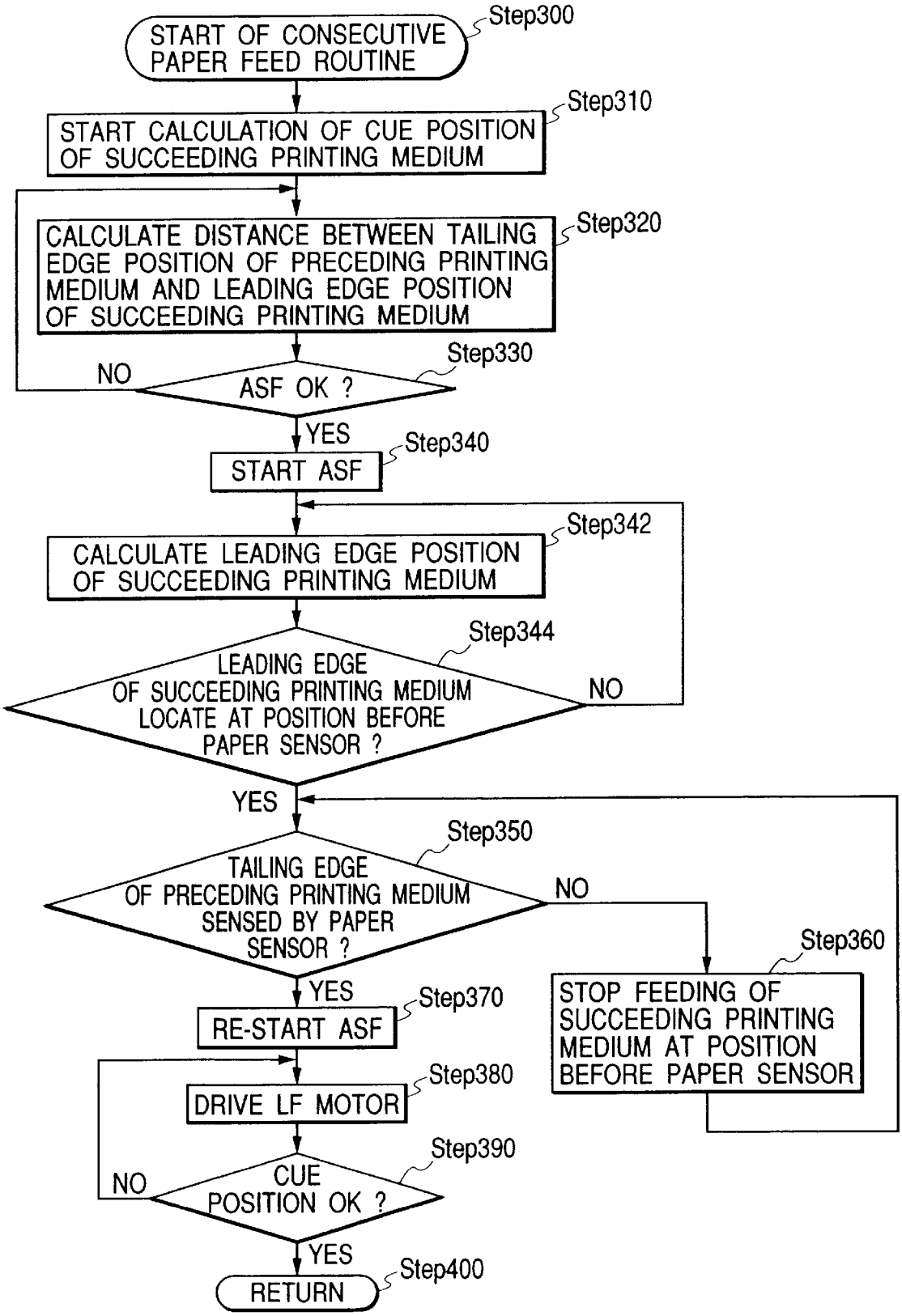
FIG. 9 is a flowchart for the control performed for the invention.

The consecutive paper feeding routine will now be explained referring to FIG. 9. At Step 300, the consecutive paper feeding routine is initiated, and at Step 310, the calculation of the cue position of the succeeding printing medium 40 is begun. Then, at Step 320 the position of the trailing edge of the preceding printing medium 8 is calculated using information concerning the length of the printing medium obtained in advance. The positional information on the trailing edge of the preceding printing medium 8 is subtracted from the leading edge of the succeeding printing medium 40 to obtain positional difference information. At Step 330, the positional difference information is employed to determine whether the rotation of the paper feeding roller 31 of the ASF 32 should be begun to separate and feed a succeeding printing medium 40. This positional difference information may be either positive or negative, and in this embodiment, positive information is defined as representing a state wherein there is no overlap of paper, while the negative information is defined as representing there is such overlap. In short, as a condition it is only necessary that the preceding printing medium 8 has already passed the paper feeding roller 31 and thus the succeeding printing medium 40 can be separated and fed. In this embodiment, the positional difference information is used to control the rotation of the paper feeding roller 31. However, information on the distance from the paper feeding roller 31 may be employed regarding the start of the rotation of the paper feeding roller 31. At Step 340, the rotation of the paper feeding roller 31 of the ASF 32 is begun. And at Step 342, the position of the leading edge of the succeeding printing medium 40 is calculated, and at Step 344, it is determined whether the printing medium 8 has reached a location immediately preceding the paper sensor 33. This determination process is repeated until the leading edge of the succeeding printing medium 40 is positioned immediately before the paper sensor 33. When it is determined that the leading edge of the succeeding printing medium 40 has reached the location preceding the paper sensor 33, at Step 350 a check is performed to determine whether the paper sensor 33 indicates the absence of paper based on a detection result of the trailing edge of the preceding printing medium 8. If the absence of paper is not detected, the feeding of the succeeding printing medium 40 is stopped at Step 360. In this embodiment, instead of the slippage of the feeding, the reduction of the feeding speed may be done. In this state, the preceding and succeeding printing media 8 and 40 are fed while overlapping each other, or while there is almost no interval between them. While the paper feeding is halted, the preceding printing medium 8 is independently transported by the conveyor roller 9, which is a sub-scanning mechanism. Therefore, at a certain time the paper sensor 33 detects the presence of paper. At this time, the minimum required interval between the preceding and the succeeding printing media 8 and 40 is kept, and thereafter, at Step 370 the rotation of the paper feeding roller 31 and the paper feeding are resumed. Subsequently, at Step 380 the conveyor roller 9 is rotated at the same speed as the paper feeding speed, and at Step 390 the preceding printing medium 8 is conveyed in the sub-scanning direction until it reaches the cue position. Then, when the cue position is OK, at Step 400 the consecutive paper feeding routine is terminated.

In the above embodiment, paper feeding control is exercised by using the information concerning the length of the printing medium obtained from the host computer. However, identification information for a paper cassette, key entry performed at the printing apparatus, or information from any sensor to obtain the length of a printing medium in the printing apparatus may be employed for the control.

As another example, the length information of the printing medium may be a fixed value. In this case, the fast feeding effects obtained by employing consecutive paper feeding vary depending on the length of a printing medium; however, the fixed value information is an effective means to use when the length of a printing medium that is normally used is comparatively fixed. A specific explanation will now be given for a case wherein LETTER size is used as the normally used length of a printing medium, and the sizes A4 and A5 are used as the other lengths. Based on the above embodiment, at the position where the distance L between a preceding printing medium 8 (LETTER size) and a succeeding printing medium 40 is optimal, the feeding of the succeeding printing medium 40 is always initiated, and the other processes are the same as in the before-mentioned embodiment. Next, it is contemplated that an A4 size printing medium is fed in this apparatus. Since the A4 size printing medium is longer than the LETTER size printing medium, the paper feeding process is initiated with the printing media interval L being always negative. In this invention, however, since the leading edge of the succeeding printing medium 40 is held at a location immediately preceding the paper sensor 33 until the trailing edge of the preceding printing medium indicates the absence of paper, fast consecutive paper feeding can be performed at the optimal printing media interval L. Next, it is contemplated that such a printing medium as A5 size, which is shorter than A4 size, is used. In this case, while the printing media interval L is very large, the paper feeding is performed as controlled in the other points, and no inconvenience is raised. The effects afforded by consecutive paper feeding are merely reduced by the shortage in length of the printing medium. As described above, the provided effects are reduced only when the length of a normally used printing medium is short. In the other cases, however, the effects provided by the fast paper feeding of the present invention are fully demonstrated. Further, in this embodiment, since means for obtaining information on the length of the printing media is not required, the present invention is very effective for a simple printing apparatus.

The following problem plagues a system comprising a plurality of driving sources so as to increase printing speed, that initiates the feeding of a succeding printing medium without detecting the trailing end of a preceding printing medium. For example, when the lengths of printing media differ between a predecessor and a successor or when the lengths of the printing media vary, or when slippage occurs at a paper feeding mechanism, preceding and succeding media overlap each other, so that a trailing edge of the preceding printing medium and a leading edge of the succeeding one cannot be discriminated, thereby causing paper feeding failures. If the trailing end of the preceding printing medium is detected first and then the feeding of the succeeding printing medium is started, the above problem can be avoided. However, unless the sensor for the printing medium is located very near the feeding mechanism, a satisfactory effect can not be obtained because the interval between the preceding and succeeding printing media will be extended. Further, in the printing apparatus, the leading edges of printing media are detected immediately after the media are fed by a feeding mechanism, so that, if because of slippage the feeding distance of the printing media varies before they reach the sub-scanning mechanism, there is no means available to correct such variation. Therefore, no printing apparatuses can cope with reductions in the intervals between printing media that are consecutively fed, stabilization in positioning the leading edges, and differences in the lengths of printing media. To resolve this problem, the printing apparatus of this invention includes one paper sensor and length information of the printing medium which comprises means for employing only the length information of the printing medium to determine a paper feeding timing regardless of the information received from the paper sensor and initiate the paper feeding, and means for, when a leading edge of a succeeding printing medium arrives at a point preceding the paper sensor, confirming that the trailing edge of the printing medium has passed the paper sensor, and for determining whether the paper feeding is to be continued.

Using this method, without an increase in the manufacturing costs, the interval between two printing media is minimized, and paper of different sizes can be employed. Further, even when more or less of a paper feeding error, such as slippage, occurs at the paper feeding mechanism, fast, consecutive paper feeding can be stabilized, without paper overlapping and without any reduction in the precision of cue positioning.

As is described above, according to the present invention, since fast paper feeding can be provided, fast recording is possible.

What is claimed is:

1. A printing apparatus for printing on a printing medium, employing a printing head, said apparatus comprising:

feeding means for feeding a printing medium toward said printing head;

detection means for detecting an edge of said printing medium fed by said feeding means; and control means for controlling the driving of said feeding means so as to (1) cause said feeding means to initiate the feeding of a succeeding printing medium after said feeding means initiates the feeding of a preceding printing medium and before said detection means detects a trailing edge of the preceding printing medium and (2) cause a leading edge of the succeeding printing medium to arrive at said detection means after said detection means detects the trailing edge of the preceding printing medium.

2. A printing apparatus according to claim 1, wherein on the basis of information specifying the length in a paper feeding direction of the preceding printing medium, said feeding means initiates the feeding of the succeeding printing medium.

3. A printing apparatus according to claim 2, wherein said information specifying the length of the preceding printing medium in the paper feeding direction is supplied from anything other than said printing apparatus.

4. A printing apparatus according to claim 3, wherein said information specifying the length of the preceding printing medium in the paper feeding direction is supplied by a host computer connected to said printing apparatus.

5. A printing apparatus according to claim 2, wherein said information specifying the length of the preceding printing medium in said paper feeding direction is supplied to said printing apparatus by an operator.

6. A printing apparatus according to claim 2, wherein said information specifying the length of the preceding printing medium in the paper feeding direction is information specifying the size of a printing medium, internally obtained in said printing apparatus.

7. A printing apparatus according to claim 6, wherein said information specifying the size of a printing medium, internally obtained in said printing apparatus, is obtained in accordance with a paper cassette into which printing media are loaded.

8. A printing apparatus according to claim 2, wherein said information specifying the length of preceding printing medium in the paper feeding direction is information concerning the width of a printing medium.

9. A printing apparatus according to one of claims 1 to 8, wherein said printing head is an ink-jet print head that employs thermal energy to eject ink.

10. A printing method for printing on a printing medium, employing a printing head, said method comprising the steps of:

feeding a printing medium toward said printing head;

initiating the feeding of a succeeding printing medium toward the printing head, after the feeding of a preceding printing medium is initiated and before a trailing edge of the preceding printing medium is detected at a predetermined position; and feeding the succeeding printing medium so that a leading edge of the succeeding printing medium arrives at the predetermined position after the leading edge of the preceding printing medium is detected at the predetermined position.

11. A printing apparatus for printing on a printing medium, employing a printing head, said apparatus comprising:

feeding means for feeding a printing medium toward said printing head;

detection means for detecting an edge of the printing medium fed by said feeding means; and control means for controlling the driving of said feeding means so as to cause said feeding means to initiate the feeding of a succeeding printing medium after said feeding means initiates the feeding of a preceding printing medium and before said detection means detects a trailing edge of the preceding printing medium, wherein said control means causes said feeding means to initiate the feeding of the succeeding printing medium on the basis of information specifying the length in a paper feeding direction of the preceding printing medium.

12. A printing apparatus for printing on a printing medium, employing a printing head, said apparatus comprising:

feeding means for feeding a printing medium toward said printing head;

detection means for detecting an edge of the printing medium fed by said feeding means; and control means that (1) causes said feeding means to initiate the feeding of a succeeding printing medium on the basis of information specifying the length in a paper feeding direction of a preceding printing medium, after said feeding means initiates the feeding of the preceding printing medium and before said detection means detects a trailing edge of the preceding printing medium, and (2) thereby causes a loading edge of the succeeding printing medium to arrive at said detection means after said detection means detects the trailing edge of the preceding printing medium.

13. A method of feeding a printing medium in a printing apparatus for printing on the printing medium, employing a printing head, said method comprising the steps of:

feeding a printing medium toward the printing head;

detecting an edge of the printing medium fed in said feeding step by edge detection means; and controlling a feeding operation in said feeding step so as to (1) cause initiation of the feeding of a succeeding printing medium after the feeding of a preceding printing medium is initiated in said feeding step and before the edge detection means detects a trailing edge of the preceding printing medium and (2) cause a leading edge of the succeeding printing medium to arrive at the edge detection means after the edge detection means detects the trailing edge of the preceding printing medium.

14. A method of feeding a recording medium according to claim 13, wherein based on information specifying the length in a paper feeding direction of the preceding printing medium, the feeding of the succeeding printing medium is initiated.

15. A method of feeding a printing medium in a printing apparatus for printing on a printing medium, employing a printing head, said method comprising the steps of:

feeding a printing medium toward the printing head;

detecting an edge of the printing medium fed in said feeding step by edge detection means; and controlling the feeding operation in said feeding step so as to initiate the feeding of a succeeding printing medium after the feeding of a preceding printing medium is initiated in said feeding step and before the edge detection means detects a trailing edge of the preceding printing medium, wherein in said controlling step the feeding of the succeeding printing medium is initiated on the basis of information capable of specifying the length in a paper feeding direction of the preceding printing medium.

16. A method of feeding a printing medium in a printing apparatus for printing on a printing medium, employing a printing head, said method comprising the steps of:

feeding a printing medium toward the printing head;

detecting an edge of the printing medium fed in said feeding step by edge detection means; and executing control so as to (1) initiate the feeding of a succeeding printing medium in said feeding step based on information specifying the length in a paper feeding direction of a preceding printing medium, after the feeding of the preceding printing medium is initiated in said feeding step and before the edge detection means detects a trailing edge of the preceding printing medium, and (2) thereby cause a leading edge of the succeeding printing medium to arrive at the edge detection means after the edge detection means detects the trailing edge of the preceding printing medium.

17. A printing apparatus for printing on a printing medium, employing a printing head, said apparatus comprising:

feeding means for feeding a printing medium toward said printing head;

detection means for detecting an edge of the printing medium fed by said feeding means; and control means for controlling the driving of said feeding means so as to cause said feeding means to initiate the feeding of a succeeding printing medium after said feeding means initiates the feeding of a preceding printing medium and before said detection means detects a trailing edge of the preceding printing medium.

18. A method of feeding a printing medium in a printing apparatus for printing on a printing medium, employing a printing head, said method comprising the steps of:

feeding a printing medium toward the printing head;

detecting an edge of the printing medium fed in said feeding step by edge detection means; and controlling the feeding operation in said feeding step so as to initiate the feeding of a succeeding printing medium after the feeding of a preceding printing medium is initiated in said feeding step and before the edge detection means detects a trailing edge of the preceding printing medium.

* * * * *

UNITED STATES PATENT AND TRADEMARK OFFICE

CERTIFICATE OF CORRECTION

PATENT NO. : 6,702,274 B1
DATED : March 9, 2004
INVENTOR(S) : Otsuka

It is certified that error appears in the above-identified patent and that said Letters Patent is hereby corrected as shown below:

Title page,
Item [56], References Cited, FOREIGN PATENT DOCUMENTS,
"JP 2775767 5/1998" should read -- JP 2775767 7/1998 --.

Column 1,
Lines 20 and 25, "succeding" should read -- succeeding --.

Column 8,
Line 22, "is" should read -- are --.
Line 39, "advance" should read -- advance, --.

Column 11,
Lines 54 and 59, "succeding" should read -- succeeding --.

Column 13,
Line 12, "preceding" should read -- the preceding --.
Line 67, "loading" should read -- leading --.

Signed and Sealed this

Twenty-fifth Day of January, 2005

JON W. DUDAS
*Director of the United States Patent and Trademark Office*